US006130501A

United States Patent [19]

Tong et al.

[11] Patent Number: 6,130,501

[45] Date of Patent: Oct. 10, 2000

[54] SHADOW MASK MOUNTING ARRANGEMENT FOR COLOR CRT

[75] Inventors: Hua-Sou Tong, Cary, N.C.; Wen-Chi Chen, Taipei; Hao-Cheng Hung, Jubei, both of Taiwan

[73] Assignee: Chunghwa Picture Tubes, Ltd., Taoyuan, Taiwan

[21] Appl. No.: 09/102,695

[22] Filed: Jun. 22, 1998

[51] Int. Cl.[7] ..... H01J 29/80

[52] U.S. Cl. ..... 313/402; 313/404; 313/406

[58] Field of Search ..... 313/402, 404, 313/406, 407

[56] References Cited

U.S. PATENT DOCUMENTS

| | | | |
|---|---|---|---|
| 3,735,190 | 5/1973 | Say | 315/13 |
| 3,873,875 | 3/1975 | Miller | 313/405 |
| 3,894,260 | 7/1975 | Sedivy | 313/405 |
| 5,066,886 | 11/1991 | Harner et al. | 313/404 |
| 5,072,150 | 12/1991 | Lee | 313/405 |
| 5,126,624 | 6/1992 | Ji | 313/402 |
| 5,210,459 | 5/1993 | Lee | 313/406 |
| 5,534,746 | 7/1996 | Marks et al. | 313/408 |

*Primary Examiner*—Nimeshkumar D. Patel
*Assistant Examiner*—Michael J. Smith
*Attorney, Agent, or Firm*—Emrich & Dithmar

[57] ABSTRACT

An arrangement for mounting a shadow mask, or color selection electrode, in the glass envelope of a color cathode ray tube (CRT) includes four resilient metal holders, each spot welded to a respective upper, lower or lateral portion of the shadow mask's skirt. Each holder is formed from a unitary metal strip which is shaped so as to include an inner mounting portion spot welded to the mask's skirt and an outer apertured portion adapted to receive a stud attached to and extending inwardly from the CRT's glass envelope. The shadow mask undergoes thermal deformation, or doming, when heated by electron beams incident thereon and transfers heat to each of the metallic holders. Each of the metallic holders, in turn, undergoes thermal deformation, but because of the shape and orientation of the holders relative to the shadow mask, the four holders deflect the shadow mask in a direction generally perpendicular to and outward from the CRT's glass display screen, i.e., along the CRT's Z-axis. By deflecting the thermally deformed shadow mask along the CRT's Z-axis, alignment between the mask's beam passing apertures and phosphor deposits on the CRT's display screen is maintained and video image color purity is not degraded.

15 Claims, 2 Drawing Sheets

SHADOW MASK MOUNTING ARRANGEMENT FOR COLOR CRT

FIELD OF THE INVENTION

This invention relates generally to color cathode ray tubes (CRTS) and is particularly directed to an arrangement for mounting an apertured shadow mask in the glass envelope of a CRT in a manner which maintains alignment between the mask's electron beam passing apertures and phosphor deposits on the inner surface of the CRT's display screen.

BACKGROUND OF THE INVENTION

Referring to FIG. 1, there is shown a plan view of a conventional installation for mounting a shadow mask 10 within the glass envelope 18 of a color CRT. Additional details of the resilient metal holders used for attaching the shadow mask 10 to the inner surface of the CRT's glass envelope 18 are shown in FIGS. 2 and 3. FIG. 4 is a partial sectional view of shadow mask 10 shown in closely spaced relation to a display screen, or glass faceplate, 28 attached to the front of the CRT's glass envelope 18.

Shadow mask 10 includes an inner portion 14 having a plurality of spaced electron beam passing apertures, some of which are shown as elements 10*a* in FIG. 1. Disposed about and connected to the inner apertured portion 14 of shadow mask 10 is a shadow mask skirt 12. The shadow mask's inner apertured portion 14 and outer skirt 12 form a generally planar, or flat, structure. Attached to the outer periphery of the shadow mask skirt 12 by conventional means such as weldments and disposed about the shadow mask skirt is a shadow mask frame 16 having a generally rectangular shape. Disposed about the shadow mask frame 16 and attached to respective upper, lower and lateral portions of the shadow mask frame are four resilient metal holders, or springs, 20*a*, 20*b*, 20*c* and 20*d*. All four resilient metal holders are identical in configuration, structure and function, with resilient metal holders 20*c* and 20*d* respectively shown in FIGS. 2 and 3. Resilient metal holder 20*d* is described in detail below, with the description provided being equally applicable to the remaining three holders.

A first end of resilient metal holder 20*d* is securely attached to the shadow mask frame 16 by conventional means such as spot weldments 30. Incorporated in resilient metal holder 20*d* are a pair of spaced embossed portions 32 which facilitate flexure of an intermediate portion of the metal holder relative to the first end portion attached to the shadow mask frame 16. A second, opposed end of the resilient metal holder 20*d* is provided with an aperture 34 for receiving a mounting stud attached to an inner surface of the CRT's glass envelope 18. Thus, each of the four resilient metal holders 20*a*–20*d* includes a respective aperture for receiving in a tight-fitting manner a respective mounting stud 22*a*–22*d* as shown in FIG. 1. Each of the mounting studs 22*a*–22*d* is attached to an inner surface of the CRT's glass envelope 18 by means of a respective mounting fixture, as shown for the combination of mounting stud 22*d* and mounting fixture 24 in FIG. 4. Each combination of a mounting pin and mounting fixture is attached to the inner surface of the CRT's glass envelope 18 by conventional means such as a weldment or glass frit.

As also shown in FIG. 4, shadow mask 10 with its large number of electron beam passing apertures 10*a* is disposed in closely spaced relation to the CRT's display screen 28 on a forward portion of glass envelope 18. Disposed on an inner surface of the CRT's display screen 28 is a phosphor layer 36 comprised of a large number of discrete phosphor deposits, or elements, which emit light when an electron beam is incident thereon to produce a video image on the display screen.

Shadow mask 10 undergoes thermal deformation as a result of the electron beams which are directed onto the shadow mask and in large part pass through its many apertures 10*a*. Those portions of the incident electron beams which do not transit the apertures 10*a* in shadow mask 10 raise the temperature of the shadow mask producing the aforementioned thermal deformation, which is commonly referred to as mask "doming". Because of this heating of the shadow mask 10 and the metal-to-metal contact between the shadow mask and each of the four resilient metal holders, heat is transferred from the shadow mask to each of the four resilient metal holders. Heating of the resilient metal holders causes the metal holders to also undergo thermal deformation causing the four resilient metal holders to rotationally displace the shadow mask 10 in a clockwise direction in an X-Y plane, or in the direction of arrow 26 in FIG. 1. Clockwise rotation of the shadow mask 10 is due to the axis of deformation of the four metal holders which is along their respective longitudinal axes.

Resilient metal holders of the bi-metal type are typically used in combination with a shadow mask comprised of aluminum killed (AK) steel. These bimetallic type resilient metal holders compensate somewhat for shadow mask rotation by moving the shadow mask 10 and frame 16 assembly toward the CRT's display screen, or outwardly from the plane of FIG. 1 in the direction of the Z-axis of the CRT. In the case of a shadow mask comprised of Invar which is typically flatter in shape and includes a finer aperture pitch, i.e., increased number of apertures begin per unit area, resilient metal holders comprised of a single metal such as of a stainless steel (either SS302 or SS310) are used. However, both prior art approaches suffer from the aforementioned directional rotation of the shadow mask in the X-Y plane due to the heating and thermal deformation of both the shadow mask and the resilient metal holders. Shadow mask rotation degrades color purity of the video image presented on the CRT's display screen, particularly in the corners of the display screen, because of the associated electron beam landing misregistration. The problems of electron beam landing misregistration and color purity degradation become even more severe in the case of shadow masks with finer aperture pitch and flatter configurations as commonly encountered in larger CRT's.

The present invention addresses the aforementioned limitations of the prior art by providing a shadow mask mounting arrangement including a plurality of spaced, resilient metal holders for attaching the shadow mask to the inner surface of the CRT's glass envelope in a manner which maintains alignment of the mask's apertures with phosphor deposits on the CRT's display screen. The inventive resilient metal holders maintain this alignment even as the shadow mask and holders undergo thermal deformation during CRT operation.

OBJECTS AND SUMMARY OF THE INVENTION

Accordingly, it is an object of the present invention to provide an improved mounting arrangement for an apertured shadow mask in a color CRT which maintains alignment between the mask's electron beam passing apertures and phosphor deposits on the inner surface of the CRT's display screen by compensating for mask thermal deformation.

It is another object of the present invention to compensate for shadow mask thermal deformation in a color CRT by deflecting the shadow mask in a direction outward from and generally perpendicular to the CRT's display screen while maintaining alignment between the shadow mask's beam passing apertures and phosphor deposits on the inner surface of the display screen.

It is another object of the present invention is to maintain video image color purity in a color CRT by compensating for doming of the CRT's shadow mask, or color selection electrode.

The present invention contemplates an arrangement for attaching a shadow mask to a glass envelope of a color cathode ray tube (CRT) having a longitudinal Z-axis, wherein the CRT further includes a display screen disposed on a front of said glass envelope and aligned generally perpendicular to said Z-axis and having a plurality of spaced phosphor deposits thereon, the arrangement comprising a shadow mask having a generally planar, inner portion with plural apertures and a skirt disposed about and attached to the inner portion, wherein plural electron beams are directed onto the shadow mask and through the plural apertures therein causing the shadow mask to undergo thermal deformation; plural retaining structures attached to and disposed in a spaced manner about an inner portion of the CRT's glass envelope; and plural resilient holders attached to the skirt of the shadow mask and disposed about the shadow mask in a spaced manner, wherein heat is transferred to the resilient holders from the shadow mask and thermal deformation occurs in the resilient holders, and wherein each resilient holder has a longitudinal axis aligned with the Z-axis of the CRT and undergoes thermal deformation along its longitudinal axis so as to urge the shadow mask in a direction parallel to the CRT's Z-axis to maintain alignment of the shadow mask apertures with the phosphor deposits on the CRT's display screen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the varios figures, in which:

DETAILED DESCRIPTION OF THE PREFERRED EMBODIMENTS

Figure 1:
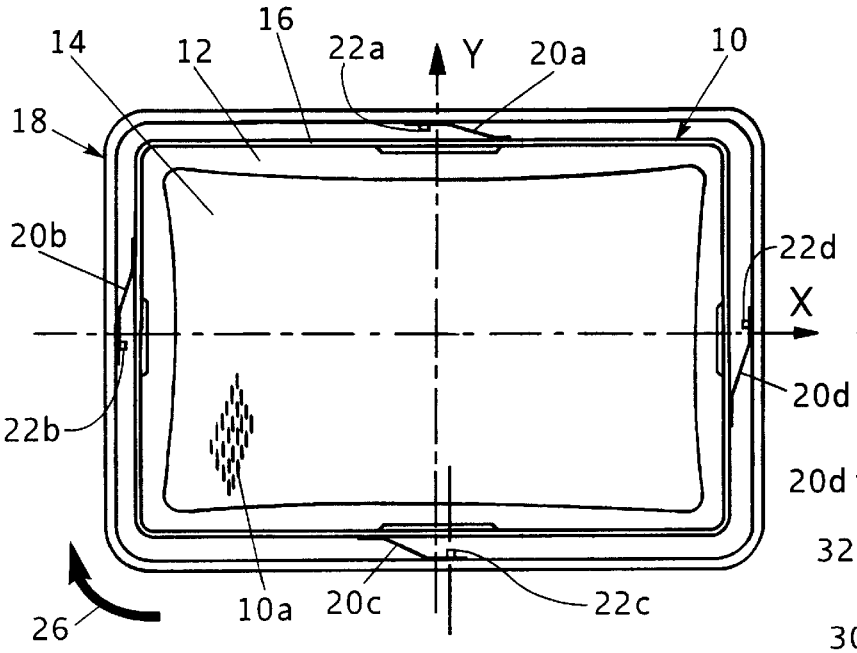
FIG. 1 (PRIOR ART)
FIG. 1 is a plan view of a prior art shadow mask installation in the glass envelope of a color CRT.
Figure 3:
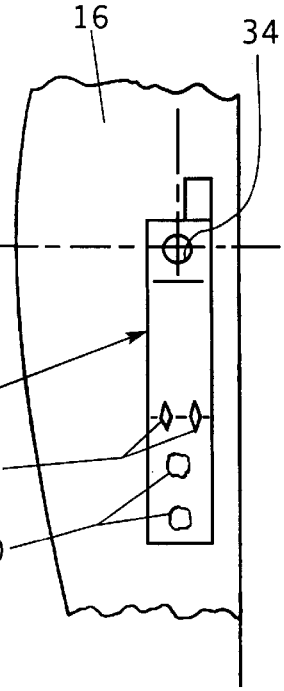
FIG. 3 (PRIOR ART)
FIGS. 2 and 3 are plan views showing details of a pair of resilient metal holders used to attach the shadow mask to the CRT's glass envelope in the prior art installation of FIG. 1.
Figure 2:
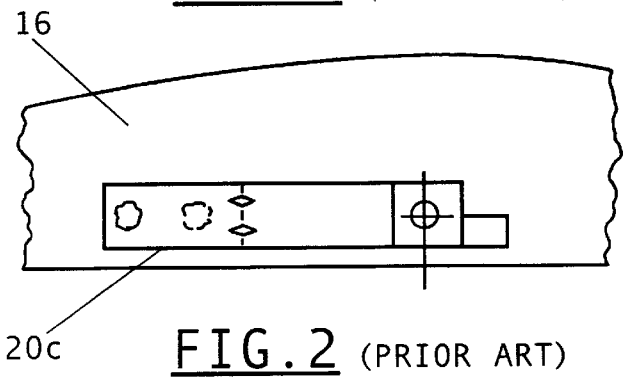
FIG. 2 (PRIOR ART)
Figure 4:
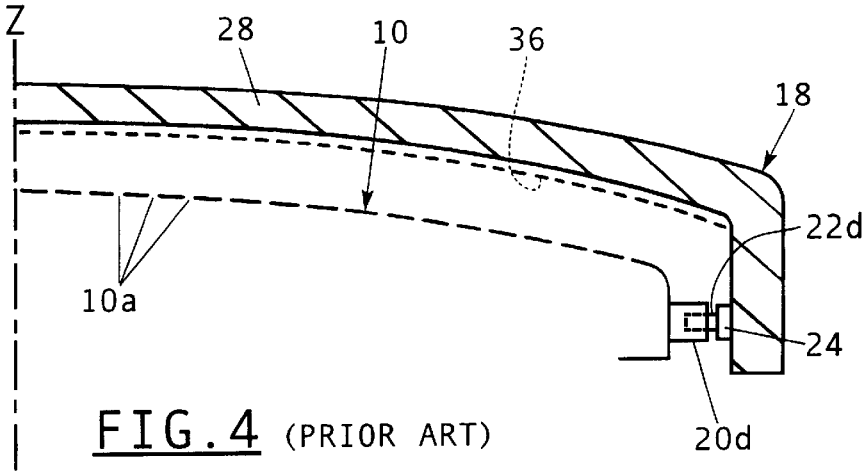
FIG. 4 (PRIOR ART)
FIG. 4 is a partial sectional view showing additional details of a typical prior art mounting arrangement for attaching a shadow mask to the glass envelope of a color CRT.
Figure 5:
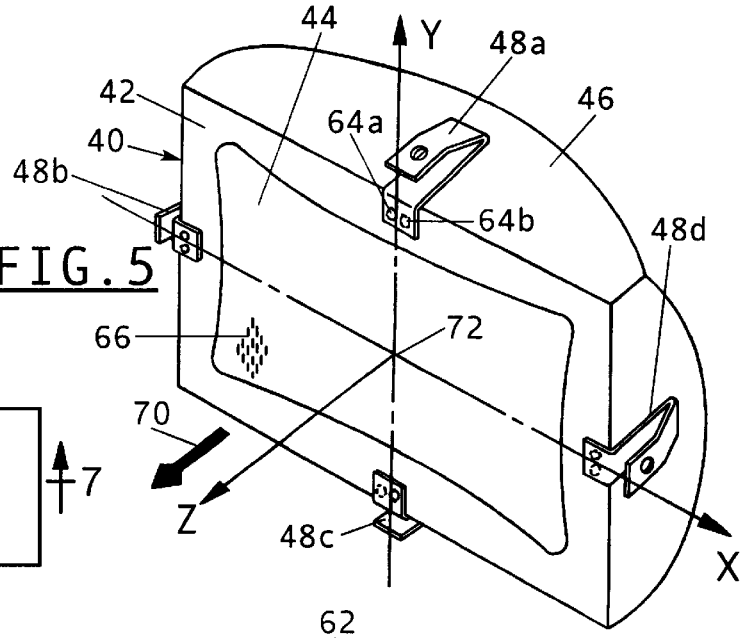
FIG. 5 is a perspective view of a shadow mask incorporating resilient metal holders in accordance with the present invention for attaching the shadow mask to the inner surface of the CRT's glass envelope.
Figure 6:
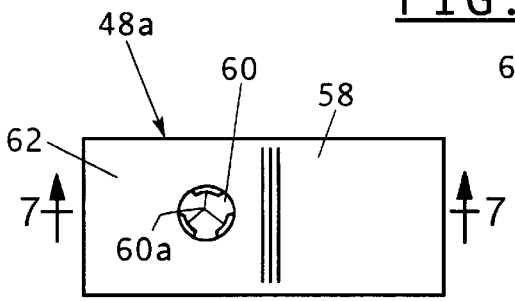
FIGS. 6, 7, 8 and 9 are respectively top plan, lateral sectional, bottom plan, and front elevation views of a resilient metal holder for mounting a shadow mask in the glass envelope of a color CRT in accordance with the present invention.
Figure 7:
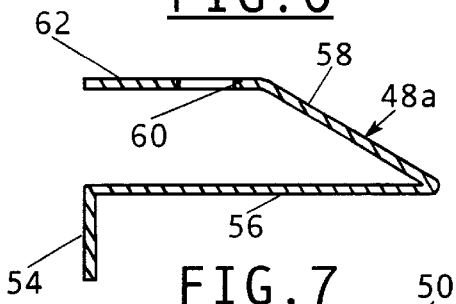
Figure 9:
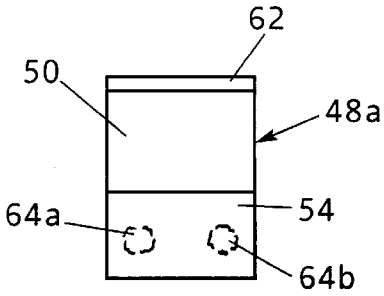
Figure 8:
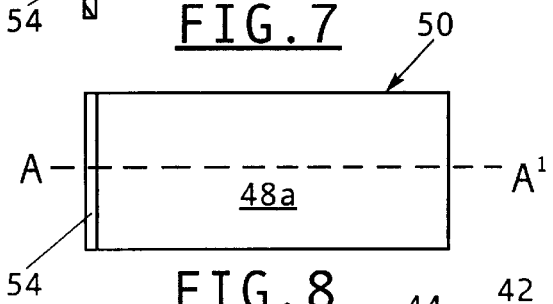
Figure 10:
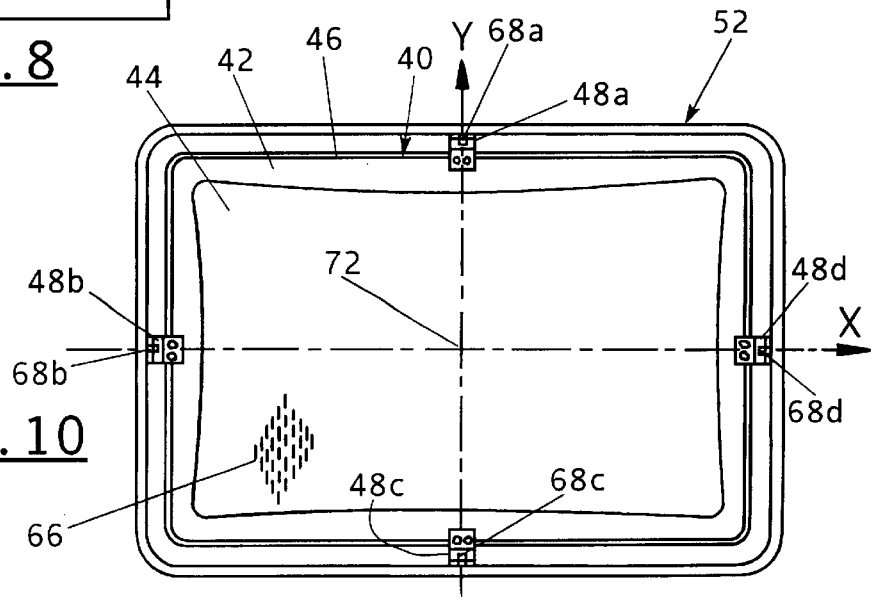
FIG. 10 is a plan view showing additional details of the mounting of a shadow mask in the glass envelope of a color CRT in accordance with the present invention.

Referring to FIG. 5, there is shown a front perspective view of a shadow mask 40 to which four resilient metal holders 48*a*, 48*b*, 48*c* and 48*d* are attached for mounting the shadow mask within the glass envelope of a color CRT. FIG. 10 is a front elevation view of the shadow mask 40 mounted in and attached to the CRT's glass envelope 52. FIGS. 6, 7, 8 and 9 are respectively top plan, lateral sectional, bottom plan, and front elevation views of one of the resilient metal holder 48*a* shown in FIGS. 5 and 10 in accordance with the present invention for mounting a shadow mask within the color CRT's glass envelope. The sectional view of FIG. 7 is taken along site line 7—7 in FIG. 6.

Shadow mask 40 includes an inner apertured portion 44 containing a large number of vertically elongated electron beam passing apertures, some of which are shown as elements 66 in FIGS. 5 and 10. The generally planar inner apertured portion 44 of shadow mask 40 is defined by a horizontal X-axis and a vertical Y-axis in the plane of the apertured portion of the mask, and a Z-axis aligned generally perpendicular to the plane of the mask's inner apertured portion, where all three axes pass through the center of the apertured inner portion identified as element 72 as shown in FIGS. 5 and 10.

Disposed about the apertured inner portion 44 of shadow mask 40 is a shadow mask skirt 42. Attached to and disposed about the periphery of the shadow mask skirt 42 is a shadow mask frame 46 having a generally rectangular shape. Disposed about the shadow mask frame 46 in a spaced manner are four resilient metal holders, or springs, 48*a*, 48*b*, 48*c* and 48*d* in accordance with the present invention. Resilient metal holders 48*a* and 48*c* are disposed adjacent respective upper and lower sides of the shadow mask frame 46 and are centered on the Y-axis. Resilient metal holders 48*b* and 48*d* are disposed immediately adjacent opposed lateral portions of the shadow mask frame 46 and are centered on the X-axis. Each of the resilient metal holders 48*a*–48*d* is identical in shape, configuration and operation and is attached to the shadow mask skirt 42 as described below.

Details of the four metal holders of the present invention will now be described in terms of metal holder 48*a* with reference to FIGS. 6–9. Metal holder 48*a* is preferably comprised of a single piece of high-strength, resilient metal and is also preferably of the same type of metal as that of the shadow mask itself. Typical metals used for the resilient metal holders are aluminum killed steel, Invar, and stainless steel. Metal holder is formed, or bent, into a plurality of portions including a inner mounting portion 54, a first intermediate portion 56, a second intermediate portion 58, and an outer portion 62. The terms "inner" and "outer" for the metal holder 48*a* are taken with respect to the location on the metal holder relative to the shadow mask 40. Each of the aforementioned portions of the resilient metal holder 48 is generally planar and is capable of undergoing flexure as is the connection, or joint, between adjacent portions of the metal holder. Metal holder 48*a* is mounted to the skirt 42 of the shadow mask 40 by conventional means such as spot weldments 64*a* and 64*b*. The first intermediate portion 56 of metal holder 48*a* extends rearwardly from the inner mounting portion 54 and is disposed in contact with the shadow mask frame 46. Second intermediate portion 58 extends outwardly from the holder's first intermediate portion 56 and away from the shadow mask 40. The outer portion 62 of the metal holder 48*a* is generally parallel to its first intermediate portion 56 and extends forwardly with respect to the shadow mask 40 from the holder's second intermediate portion 58. Disposed in the holder's outer portion 62 is an aperture 60 having a plurality of spaced inner extensions 60*a* disposed about the inner periphery thereof. The aperture in each of the four resilient metal holders 48*a*–48*d* is adapted to receive and engage a respective mounting stud, or pin, attached to and extending inwardly from the CRT's glass envelope 62 as shown in FIG. 10. Thus, each of the resilient metal holders 48*a*, 48*b*, 48*c* and 48*d* includes a respective aperture therein which is adapted to receive and engage a respective mounting stud 68*a*, 68*b*, 68*c* and 68*d* attached to and extending inwardly from the CRT's glass envelope 52. Each of the mounting studs 68*a*–68*d* is attached to the inner surface of the glass envelope 52 by conventional means such as a glass frit or a weldment. The inner extensions 60*a* in aperture 60 of resilient metal holder 48*a* securely engage a mounting stud inserted in the aperture and prevent removal of the mounting stud from the metal holder.

As the temperature of the shadow mask 40 increases with the electron beams incident thereon, heat is transferred from the shadow mask to each of the four resilient metal holders 48*a*–48*d*. Shadow mask 40 undergoes thermal deformation in the form of doming, wherein it departs somewhat from its highly planar configuration at room temperature and assumes a slightly curved shape. Each of the four resilient metal holders 48*a*–48*d* undergoes a corresponding thermal deformation primarily along its longitudinal axis A–A' shown in dotted line form in FIG. 8, urging the shadow mask 40 along the longitudinal axis of the CRT, or in the direction of arrow 70 shown in FIG. 5. Displacing the shadow mask 40 along the CRT's Z-axis maintains each of the apertures 66 in the mask in alignment with its associated phosphor elements deposited on the inner surface of the CRT's display screen. Maintaining precise alignment between the shadow mask apertures and the phosphor deposits avoids video image degradation in the form of reduced color purity.

There has thus been shown an arrangement for mounting an electron beam passing apertured shadow mask within the glass envelope of a CRT which maintains the mask apertures in precise alignment with phosphor deposits on the CRT's display screen for improved video image color purity. The mask mounting arrangement includes four resilient metal holders attached to respective upper, lower and lateral portions of the shadow mask. Each resilient metal holder is adapted to receive and engage a respective mounting stud attached to and extending inwardly from the CRT's glass envelope. As the shadow mask is heated by the electron beams incident thereon, heat is also transferred to each of the four resilient metal holders. The shadow mask and metal holders undergo thermal deformation, with the metal holders expanding along their respective longitudinal axes so as to urge the shadow mask in a direction generally perpendicular to the flat front of the shadow mask, or along the CRT's Z-axis. Each of the four metal holders deforms along its longitudinal axis which is aligned with the CRT's Z-axis. By slightly displacing the shadow mask along its Z-axis, the apertures in the mask are maintained in precise alignment with associated phosphor deposits on the inner surface of the CRT's display screen so that each electron beam is incident upon its associated phosphor deposits. High video image color purity is maintained for improved CRT viewing.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An arrangement for attaching a shadow mask to a glass envelope of a color cathode ray tube (CRT) having a longitudinal Z-axis, wherein said CRT further includes a display screen disposed on a front portion of said glass envelope and aligned generally perpendicular to said Z-axis and having a plurality of spaced phosphor deposits thereon, said arrangement comprising:

a shadow mask having a generally planar, inner portion with plural apertures and a skirt disposed about and attached to said inner portion, wherein plural electron beams are directed onto said shadow mask and through the plural apertures therein causing said shadow mask to undergo thermal deformation;

plural retaining structures attached to and disposed in a spaced manner about an inner portion of the CRT's glass envelope; and plural resilient holders attached to the skirt of said shadow mask and disposed about said shadow mask in a spaced manner, wherein heat is transferred to said resilient holders from the shadow mask and thermal deformation occurs in said resilient holders, and wherein each resilient holder is a unitary metallic member and has a longitudinal axis aligned with the Z-axis of the CRT and undergoes thermal deformation along it longitudinal axis so as to urge the shadow mask in a direction parallel to the CRT's Z-axis to maintain alignment of the shadow mask apertures with the phosphor deposits on the CRT's display screen.

2. The arrangement of claim 1 wherein each of said resilient holders includes an inner mounting portion attached to the shadow mask, an outer portion attached to one of said retaining structures, and a resilient intermediate portion disposed between and coupled to said inner and outer portions.

3. The arrangement of claim 2 wherein said resilient intermediate portion expands along the longitudinal axis of the holder when heated so as to urge the shadow mask toward the display screen in a direction parallel to the CRT's Z-axis.

4. The arrangement of claim 1 wherein said shadow mask and said resilient holders are comprised of metal.

5. The arrangement of claim 4 wherein said shadow mask and said resilient holders are comprised of the same metal.

6. The arrangement of claim 5 wherein said shadow mask and said resilient holders are comprised of aluminum killed steel, stainless steel, or Invar.

7. The arrangement of claim 2 further comprising spot weldments attaching an inner mounting portion of each of said resilient holders to the skirt of the shadow mask.

8. The arrangement of claim 2 wherein the outer portion of each resilient holder includes an aperture for receiving a respective retaining structure in a tight-fitting manner.

9. The arrangement of claim 8 wherein each retaining structure includes a respective mounting stud and wherein the aperture in each resilient holder includes inner extensions for securely engaging the mounting stud.

10. A holder for attaching a shadow mask having a plurality of electron beam passing apertures to a glass envelope of a color cathode ray tube (CRT), said glass envelope having a plurality of mounting members attached to an inner portion thereof, said CRT further including a display panel disposed on a forward portion of said glass envelope and having a plurality of space phosphor deposits thereon and a Z-axis aligned with the longitudinal axis of the CRT and oriented generally perpendicular to the display panel, and wherein said holder is heated by the shadow mask and undergoes thermal deformation, said holder comprising:

an inner portion attached to the shadow mask;

an outer portion attached to a mounting member on the glass envelope; and an intermediate resilient portion disposed between and coupled to said inner and outer portions and aligned with a longitudinal axis of said holder, wherein the longitudinal axis of said holder is aligned with the Z-axis of the CRT for allowing flexure of the holder when heated along the Z-axis so as to maintain alignment of the apertures in the shadow mask with respective phosphor deposits on the display screen, and wherein said inner, outer and intermediate portions form a unitary metallic member.

11. The holder of claim 10 wherein said intermediate resilient portion expands along the longitudinal axis of the holder when heated so as to urge the shadow mask toward the display panel in a direction parallel to the CRT's Z-axis.

12. The holder of claim 11 wherein said holder is comprised of aluminum killed steel, stainless steel, or Invar.

13. The holder of claim 10 further comprising spot weldments attaching the inner portion of the holder to the shadow mask.

14. The holder of claim 10 wherein the outer portion of said holder includes an aperture for receiving a respective mounting member in a tight-fitting manner.

15. The holder of claim 14 wherein said mounting member includes a mounting stud and wherein the aperture in the outer portion of the holder includes inner extensions for securely engaging the mounting stud.

* * * * *